US005223902A

United States Patent [19]

Chodak et al.

[11] Patent Number: 5,223,902

[45] Date of Patent: Jun. 29, 1993

[54] HEAT AND PRESSURE FUSER INCORPORATING A MOISTURE COLLECTION AND REMOVAL SYSTEM

[75] Inventors: Charles J. Chodak, Rochester; Daniel L. Morris, Webster; William E. Kramer, Fairport, all of N.Y.

[73] Assignee: Xerox Corporation, Stamford, Conn.

[21] Appl. No.: 888,938

[22] Filed: May 26, 1992

[51] Int. Cl.[5] ..... G03G 15/20

[52] U.S. Cl. ..... 355/290; 355/215; 355/285

[58] Field of Search ..... 355/282, 285, 290, 295, 355/215

[56] References Cited

U.S. PATENT DOCUMENTS

| | | | |
|---|---|---|---|
| 4,639,405 | 1/1987 | Franke | 355/290 X |
| 4,689,471 | 8/1987 | Pirwitz et al. | 219/216 |
| 4,822,978 | 4/1989 | Morris et al. | 355/290 X |
| 4,859,831 | 8/1989 | Webb | 355/290 X |
| 4,860,047 | 8/1989 | Pirwitz | 355/290 |
| 4,996,556 | 2/1991 | Gray, Jr. | 355/50 |
| 5,040,777 | 8/1991 | Bell et al. | 271/3 |
| 5,046,146 | 9/1991 | Bartman et al. | 355/290 X |

*Primary Examiner*—A. T. Grimley
*Assistant Examiner*—Sandra L. Brasé

[57] ABSTRACT

A heat and pressure fuser for fusing toner images on copy media which includes a thin web which is wrapped around a portion of a heated fuser roll to form an extended fusing area. An enclosed cavity is formed beneath the fusing area, the cavity incorporating a moisture collection and removal system. As the copy media passes through the fusing area, its moisture content is vaporized and is condensed within the cavity, collecting in a trough at the bottom of the cavity. The water periodically drains through an outlet drain and is collected in a storage container.

8 Claims, 3 Drawing Sheets

HEAT AND PRESSURE FUSER INCORPORATING A MOISTURE COLLECTION AND REMOVAL SYSTEM

This invention relates generally to heat and pressure fusing of toner images formed on a copy substrate and, more particularly, to the fusing of images in a fusing system incorporating a low mass heated fuser roller which cooperates with an elongated web member to create the fusing area.

It is known in the prior art to use a low mass fuser roll member which cooperates with an elongated web which is wrapped around a portion of the roll member and held in engagement therewith by a biasing member. The interface between the web member and the fuser roll form the fusing area through which the copy media passes. A fusing system of this type is used in a commercial large document copying machine, the Xerox 2510, and disclosed in U.S. Pat. No. 4,689,471 assigned to Xerox Corporation. The contents of this patent are hereby incorporated by reference. As disclosed in the patent, a low mass heated fuser roll cooperates with an elongated web member, comprising a woven fabric, to form an extended fusing area. One end of the pressure web is fixed, while the other end is biased into pressure engagement with the fuser roll to form an entrance nip.

Various types of copy media may be used, including bond and tracing paper, which contain significant amounts of moisture. During the passage of the copy media through the extending fusing area, this moisture is heated and evaporates. The steam vapor can then escape into other portions of the machine creating the potential for rust and corrosion, which can inhibit machine performance. The steam can also condense and form puddles in entrapment areas throughout the machine.

It is, therefore, an object of the present invention to form a condensation cavity to proximate the fusing area, wherein escaping steam can condense and be collected by a drain system. More particularly, the present invention relates to a document copying machine, a moisture collection and removal system in combination with a heat and pressure fuser, comprising:

fusing means for fusing the toner image transferred to a copy sheet by applying heat and pressure to said copy sheet during a fusing process, and means for entrapping moisture condensing from said copy sheet during said fusing process.

Figure 1:
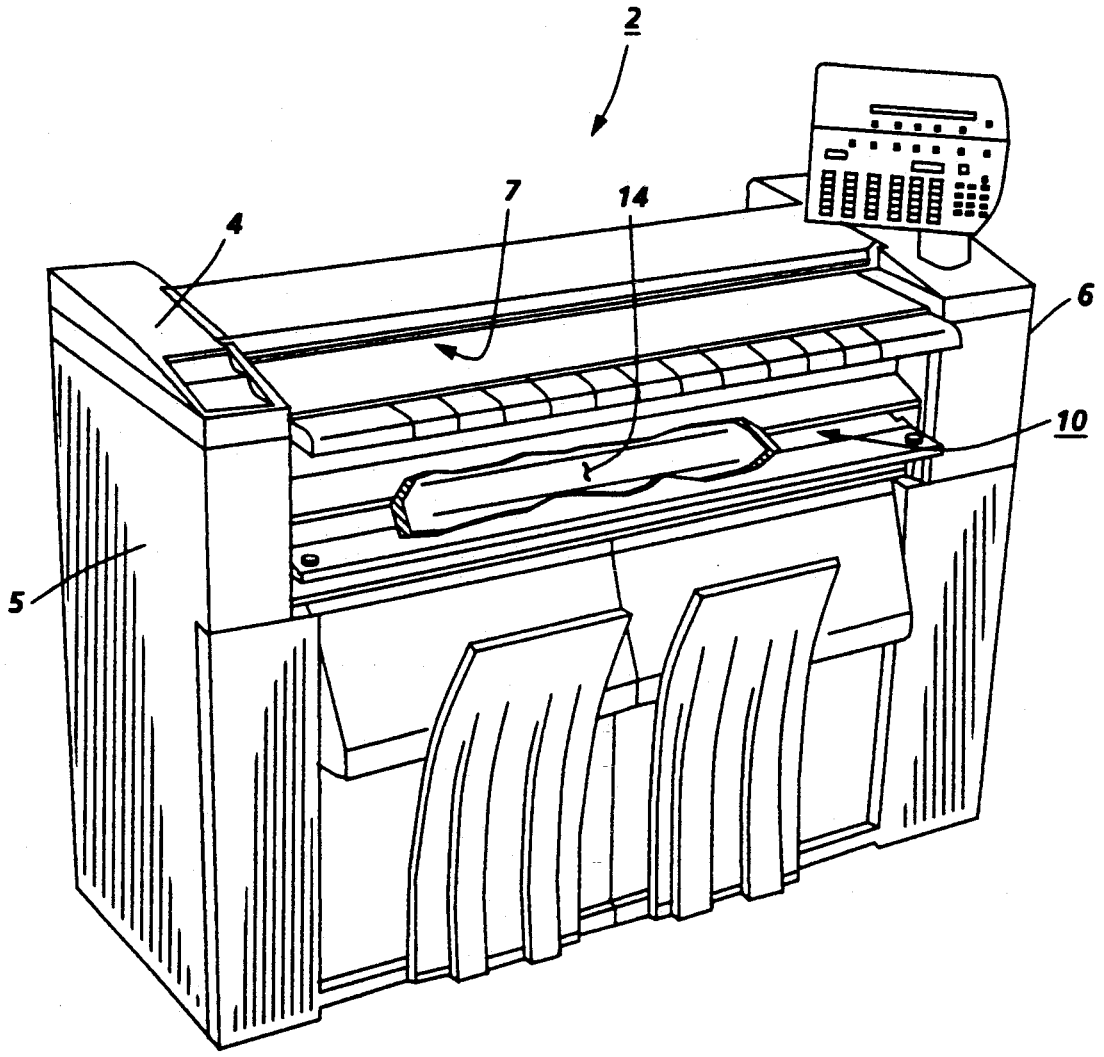
FIG. 1 is a front perspective view of one embodiment of a copying machine incorporating the moisture collection and removal system of the present invention.

FIG. 1 shows a front perspective view of a large document copier 2, which incorporates the improved moisture collection system of the present invention. The copier 2 includes a housing frame 4, having panels 5 and 6, which form the sides of frame 4. Documents are fed into an entry nip 7, either by a constant velocity transport (CVT) (not shown) feeder or manually by an operator. Within the frame 4, the xerographic subassembly is used to create an output copy of the original document. These include an exposure station to form a latent, electrostatic image of the document on the surface of a photoreceptor drum; a charging station to charge the surface of the drum; a developing station to develop the latent image formed; a transfer station to transfer the developed image to a copy sheet and a fusing station to fuse the transferred image. Further details of exemplary systems in which the present invention can be practiced are disclosed in U.S. Pat. Nos. 5,040,777 and 4,996,556, whose contents are hereby incorporated by reference. The fusing station, referred to hereafter as fusing system 10, includes an elongated fuser roll 14, located within machine frame 4, as shown in the cutaway view of FIG. 1. The moisture collection and removal system is located within system 10, as will be seen.

Figure 2:
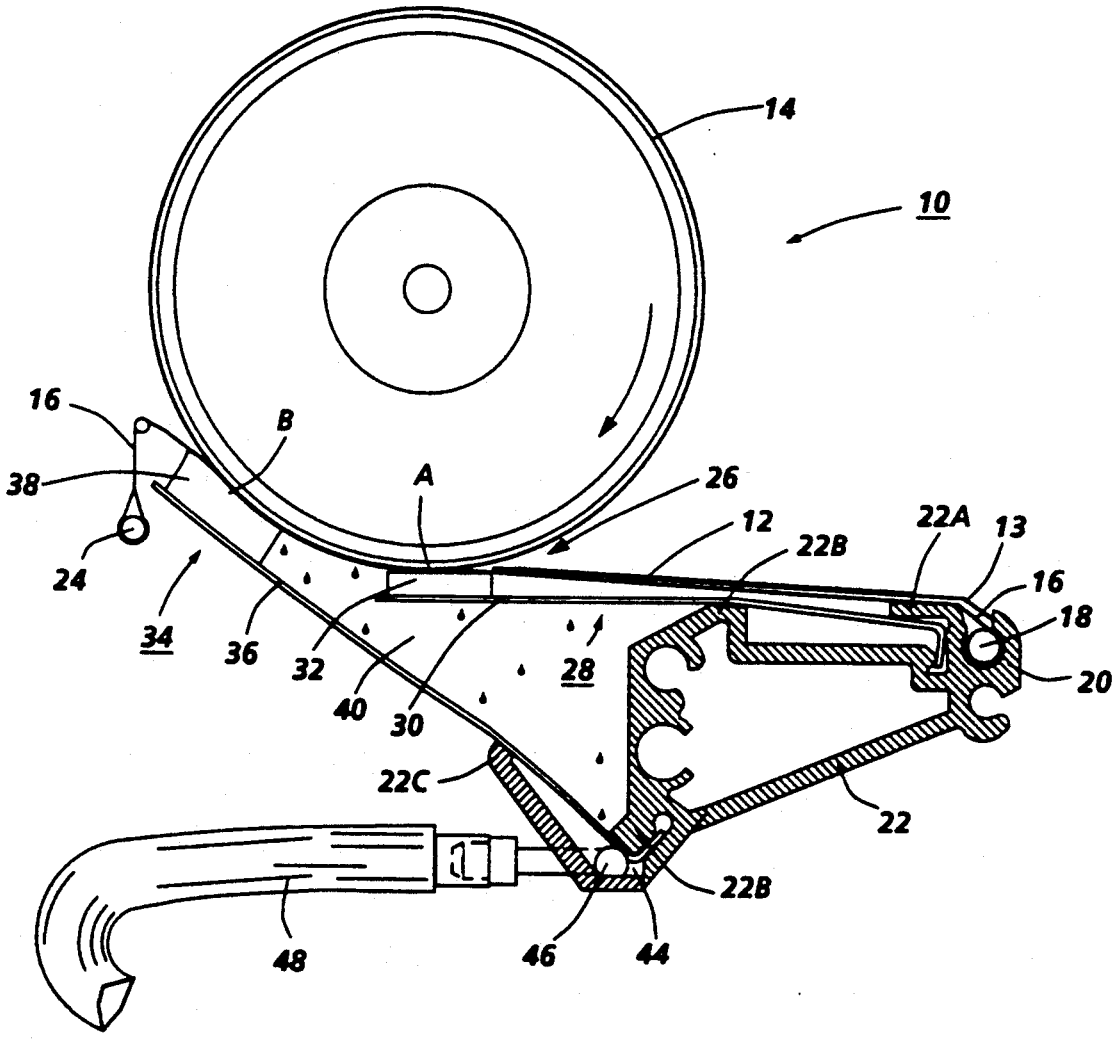
FIG. 2 is a side schematic view of the heat and pressure fusing system of FIG. 1 which incorporates the moisture collection and removal system of the present invention.

Referring to FIG. 2, there is shown a side view of the heat and pressure fusing system 10 with the covers removed. A copy sheet 12, bearing a transferred toner image, is shown moving in the indicated direction along the surface of guide member 13. It is understood that the fusing system has a length into the page. All components of the system likewise extend into the page and are commensurate in length with the fuser roll. System 10 includes a fuser roll 14 comprising a thin-walled thermally conductive tube having a thin (i.e. approximately 0.005 inch (0.01 Centimeters)) coating of silicone rubber on the exterior surface thereof, which contacts the image on the copy substrate 12 to thereby affix the image to the substrate. Fuser roll 14 is heated conventionally by an internal heating source, typically a quartz lamp. A release agent management system, not shown, applies a thin layer of silicone oil to the surface of the fuser roll for the prevention of toner offset thereto, as well as reducing the torque required to effect rotation of the fuser roll. In one operative embodiment, the fuser roll has a diameter of 3.3 inches and a length of 40 inches. This embodiment is typically used to fuse images on copy substrates that are 3 feet (0.91 meters) wide by 4 feet (1.22 meters) in length. Fuser roll 14 rotates in the direction of the arrow.

Wrapped around a portion of the fuser roll surface is a pressure web 16. Web 16 comprises a woven fabric made from heat resistant material. In the preferred embodiment, web 16 is an air-blown, permeable, Teflon-glass fabric.

One end of web 16 is wrapped around rod 18, which is anchored in cavity 20 of frame structure 22. The opposite end of web 16 is wrapped around rod 24. The copy sheet entrance nip 26 is defined by the surface of roller 14 and a first biasing member 28, comprising a flexible blade 30 having a silicon rubber pad 32 attached to the contacting surface. Blade 30 is flexed between points 22A and 22B of frame 22, to provide a biasing pressure against the web. As shown, the blade member 30 and segment 32 are mounted tangentially to the fuser roll 14 surface, biasing web 16 against the fuser roll surface.

Continuing with the description of fusing system 10, a second biasing member 34 comprises a second blade 36 having a silicone, high temperature, foam rubber pad 38 contacting the fuser roll at the exit end of the wrap angle. Blade 36 is flexed between points 22C, 22D, to bias web 16 against the fuser roll surface. Thus, web 16 is held in contact with the fuser roll surface along an extended fuser area, beginning at point A and ending at point B and extending the length of the fuser (into the page).

Figure 3:
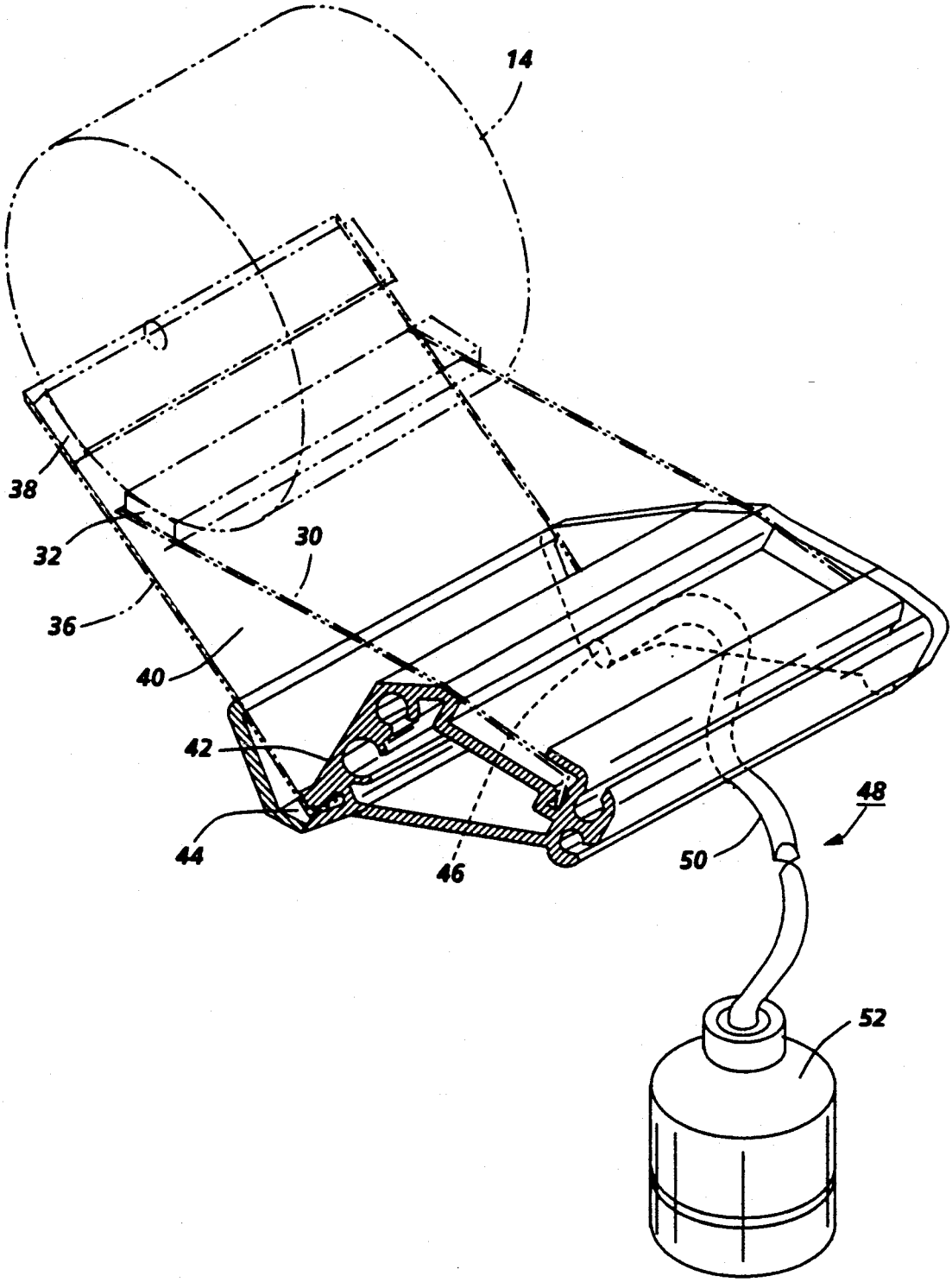
FIG. 3 is a top perspective view of FIG. 2.

According to a first aspect of the present invention, and referring to FIGS. 2 and 3, cavity 40 is created within an area bounded by the top surface of blade 36, the bottom surface of blade 28, the portion of web 16 biased against roll 14, and panels 5 and 6 of frame 4. At the bottom of the cavity is a V-shaped trough 44, having an outlet drain 46 at one end. A water collection system 48, comprising a flexible tube 50 and a collection bottle 52 is connected to drain 46.

In operation, the leading edge of sheet 12 enters the entrance nip 26 and is engaged between rotating roll 14 and pad 32. As the copy sheet 12 travels through the fusing area, extending from point A to point B, the copy sheet is subjected to heat and pressure causing the moisture within the sheet to evaporate and change to steam. The steam passes through the permeable web 16 and begins to condense on various surfaces of cavity 40; e.g. the bottom of blade member 30, the top of blade member 36, surface 42 and the side walls of frame 22. The condensation droplets descend by gravity to accumulate along the length of trough 44. When the water level reaches a certain depth which exceeds a specific surface tension, the water escapes through drain 46, passing through tube 50, and is collected in bottle 52. Bottle 52 may be periodically emptied by an operator.

It is understood that the present invention, while described in the context of a cavity formed by two biasing blades, may also assume other cavity configurations depending upon the specific machine design. For example, the fusing operation may be accomplished by passing the copy sheet with the transferred image between a heated fuser roll and a biased pressure roll, as is known in the art. For this configuration, the cavity and water collection system would be located directly beneath the fuser roll pair.

While the invention has been described with reference to the structures disclosed, it is not confined to the details set forth, but is intended to cover such modifications or changes as they come within the scope of the following claims.

What is claimed is:

1. In a document copying machine, a moisture collection and removal system in combination with a heat and pressure fuser, comprising:

fusing means for fusing the toner image transferred to a copy sheet by applying heat and pressure to said copy sheet during a fusing process, and means for entrapping moisture condensing from said copy sheet during said fusing process, said entrapping means including a generally enclosed cavity located beneath said fusing means, said cavity having a collection area for said entrapped moisture.

2. The machine of claim 1 further including means for automatically removing said entrapped moisture from said machine.

3. The machine of claim 1 wherein said fuser means is a rotatable heated fuser roll, which operates in combination with a thin permeable web in pressure contact with the fuser roll along a wrap angle area, said wrap angle area defining the area in which the toner image is fused, and wherein said enclosed cavity is formed at least partially beneath said wrap angle area, said cavity adapted to trap and remove moisture which has escaped from said copy sheet during passage of the copy sheet through said wrap angle.

4. The machine of claim 3 further including web biasing means for maintaining the web in contact with the roll surface, said web biasing means forming part of said enclosed cavity.

5. The machine of claim 4 wherein said entrapped moisture collection area is a trough at the bottom of said cavity, said trough connected to an outlet drain and collection system.

6. The machine of claim 5 wherein said web biasing means includes a first and second blade member for applying pressure to said web at two points of the wrap angle area, said blades positioned so as to allow moisture escaping from said web member to descend into said cavity.

7. In a heat and pressure fusing system for fusing a toner image on a copy sheet having a leading and trailing edge comprising:

a rotatable heated fuser roll, a thin permeable web in pressure contact with the fuser roll along a wrap angle area, said wrap angle area defining the area in which the toner image is fused, and an enclosed cavity formed beneath said wrap angle area, said cavity adapted to trap and remove moisture which has escaped from said copy sheet during passage of the copy sheet through said wrap angle.

8. The system of claim 7 further including web biasing means for maintaining the web in contact with the roll surface, said web biasing means including a first and second blade member forming part of said enclosed cavity.

* * * * *